US005769624A

United States Patent [19]

Luxton et al.

[11] Patent Number: 5,769,624

[45] Date of Patent: Jun. 23, 1998

[54] VARIABLE FLAME BURNER CONFIGURATION

[75] Inventors: Russell Estcourt Luxton, Eastwood; Graham Jerrold Nathan, Blackwood, both of Australia

[73] Assignee: Luminis Pty. Ltd, Adelaide, Australia

[21] Appl. No.: 403,706

[22] PCT Filed: Sep. 17, 1993

[86] PCT No.: PCT/AU93/00476

§ 371 Date: May 15, 1995

§ 102(e) Date: May 15, 1995

[87] PCT Pub. No.: WO94/07086

PCT Pub. Date: Mar. 31, 1994

[30] Foreign Application Priority Data

Sep. 18, 1992 [AU] Australia ..... PL4827

[51] Int. Cl.[6] ..... F23D 23/00

[52] U.S. Cl. ..... 431/284; 431/8; 431/187; 431/278

[58] Field of Search ..... 431/278, 280, 431/281, 283, 284, 285, 8, 9, 157, 158, 174, 175, 181, 187, 350, 353

[56] References Cited

U.S. PATENT DOCUMENTS

| | | | |
|---|---|---|---|
| 2,138,998 | 12/1938 | Brosius | 431/8 |
| 2,308,902 | 1/1943 | Weller . | |
| 2,531,316 | 11/1950 | Zink | 431/284 |
| 3,671,172 | 6/1972 | Chedaille et al. | 431/284 |
| 3,954,382 | 5/1976 | Hirose | 431/9 |
| 4,095,929 | 6/1978 | McCartney | 431/19 |
| 4,285,663 | 8/1981 | Boder | 431/8 |
| 4,505,666 | 3/1985 | Martin et al. | 431/285 |
| 4,744,748 | 5/1988 | Raines et al. | 431/354 |
| 4,957,050 | 9/1990 | Ho | 431/9 |
| 5,060,867 | 10/1991 | Luxton et al. | 431/9 |
| 5,163,830 | 11/1992 | Pfefferkorn | 431/355 |

FOREIGN PATENT DOCUMENTS

| | | | |
|---|---|---|---|
| 287575 | 4/1963 | Australia . | |
| 8899982 | 4/1983 | Australia . | |
| 501821 | 6/1930 | Germany | 431/281 |
| 035814 | 12/1988 | Japan | 431/8 |

*Primary Examiner*—Carl D. Price
*Attorney, Agent, or Firm*—Sughrue, Mion, Zinn, Macpeak & Seas, PLLC

[57] ABSTRACT

A burner configuration includes at least one processing jet nozzle and at least one further burner nozzle having mixing characteristics different from the processing jet nozzle. A means is preferably provided to control the proportions of fuel flow to the nozzles. The nozzles of the set are in sufficient proximity that a combined flame of the burner configuration can be determined or controlled by setting or varying the relative flows of fuel to the nozzle of the set.

7 Claims, 3 Drawing Sheets

VARIABLE FLAME BURNER CONFIGURATION

FIELD OF THE INVENTION

This invention relates to a burner configuration and in preferred embodiments to a variable flame burner configuration. The invention has particular though certainly not exclusive application to a variable flame burner fuelled by natural gas and is applicable to kilns such as rotary cement kilns, furnaces and other process heating arrangements. The invention also relates to a method of generating a burner flame.

BACKGROUND ART

The present applicant's international patent publication WO88/08104 (PCT/AU88/00114) and the associated U.S. Pat. No. 5,060,867 disclose a fluid mixing nozzle in which a primary flow of a first fluid separates from the internal wall structure and reattaches itself asymmetrically to the wall upstream of the nozzle outlet. A flow of a second fluid induced through the outlet swirls in the chamber between the flow separation and reattachment and induces precession of the separated reattached flow, which exits the nozzle asymmetrically. This nozzle has come to be termed a precessing jet nozzle and such terminology is adopted herein. By the optional addition of a centre-body within the chamber, part of the primary flow can be caused to recirculate within the chamber and induce the precession.

When the precessing jet nozzle is operated as a burner, using eg natural gas as the fuel and primary flow, it has been observed that, in comparison with a simple turbulent jet burner, the precessing jet nozzle generates a more bulbous flame whose stand-off distance is reduced by an order of magnitude and whose blow-off velocity is increased by a factor of four. These features have been found to enhance the stability and radiation characteristics of the flame in furnaces and boilers and to enhance the performance of kilns such as rotary cement kilns employed to produce cement clinker. Both the quality of the clinker produced in such kilns and the energy required to produce it, are significantly influenced by the "heat release profile" of the flame generated by the burner and by the proportion of the energy which is radiated, as opposed to being convected, to the product. The heat release profile of the flame is the proportion of the total energy which is released in each part of the kiln, and it will thus be appreciated that the precessing jet burner, with its closer bulbous flame and higher blow-off velocity, is well suited in principle to kiln application.

Preliminary trials of the precessing jet nozzle burner in a cement kiln have demonstrated a reduction in $NO_X$ emissions by up to 75% relative to a more conventional turbulent jet burner and have shown potential to benefit the clinkering process. However, the flame has been found to release too much heat at the front of the kiln during some phases of the kiln operation, which adversely affects the life of the refractory bricks. Similar constraints may be anticipated in some applications of the precessing jet nozzle burner to other direct process heating in, for example, the metals, glass and chemical industries.

SUMMARY OF THE INVENTION

In accordance with the invention, it has been realised that the aforementioned problem can be overcome, and perhaps other advantages obtained, by providing a burner configuration including at least one precessing jet nozzle and at least one further burner nozzle having mixing characteristics different from the precessing jet nozzle.

Most generally, the invention provides a burner configuration comprising a set of fuel nozzles including at least one precessing jet nozzle and at least one further nozzle having mixing characteristics which are different from the precessing jet nozzle.

Preferably, the burner configuration further includes means to set or control the proportions of fuel flow to the nozzles, wherein the nozzles of the set are in sufficient proximity that the combined flame of the burner configuration can be determined or controlled by setting or varying the relative flows of fuel to the nozzles of the set.

The further nozzle(s) may be a simple turbulent jet nozzle, eg a straight pipe nozzle, whereby the precessing jet nozzle produces a flame which is relatively shorter and more radiant and the flame of the further nozzle(s) is relatively longer and more convective.

The precession of the jet emerging from the precessing jet nozzle causes mainly large scale mixing of the jet with the surrounding fluid. The jet from a conventional nozzle produces mainly fine scale mixing with the surrounding fluid. By combining the two types of nozzle and adjusting the proportions of the fuel flows through each, the mixing characteristics and hence the resulting flame shape can be modified. Further, the large scale mixing associated with the precessing jet nozzle causes a region of fuel-rich combustion which, for a gaseous fuel, generates a highly radiant but relatively low temperature flame close to the nozzle exit. By contrast, the fine scale mixing associated with a conventional jet nozzle generates an almost transparent high temperature blue flame with a gaseous fuel. The generation of $NO_X$ increases with flame temperature.

It will be appreciated that, by adjustment of the control means, the ratio of the total gas flow which is introduced through each nozzle can be varied so that the heat release profile of the combined flame can be tailored to the current requirements of the kiln or other process.

By "different mixing characteristics" herein, in relation to the burner nozzles, is meant that the mixing of fuel and air generated at the respective nozzles is sufficiently different in character for the resultant flames to have different characteristics, e.g. with respect to one or more of shape, width, length, luminosity, temperature and colour.

The invention also provides a method of generating a burner flame.

DESCRIPTION OF PREFERRED EMBODIMENTS

Figure 1:
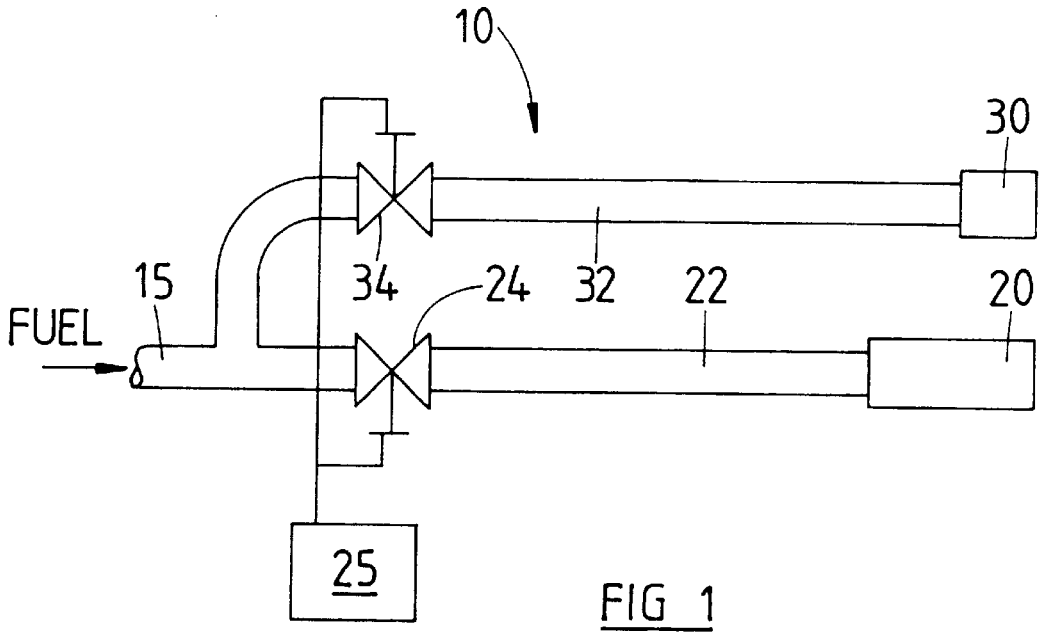
FIG. 1 schematically depicts a simple burner configuration according to a first embodiment of the invention.

The burner configuration 10 illustrated in FIG. 1 includes a pair of generally tubular nozzles 20,30 arranged side-byside with their longitudinal axes parallel. The nozzles 20,30 are supplied with fuel, typically natural gas, by respective feed pipes 22,32, from a common delivery pipe 15 via respective control valves 24,34.

Nozzle 20 is a precessing jet nozzle and nozzle 30 a simple turbulent jet nozzle.

Figure 2:
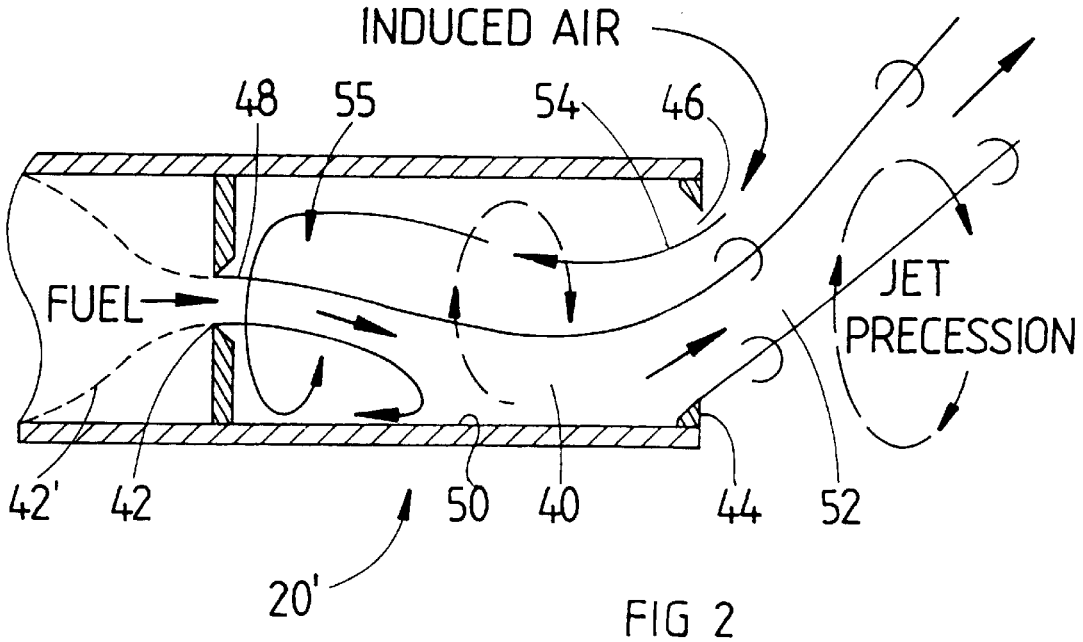
FIG. 2 is a diagrammatic cross-section of a precessing jet nozzle suitable for the burner configuration of FIG. 1, including a simple flow representation of the instantaneous pattern of the three-dimensional dynamically precessing and swirling flow thought to exist in and around the precessing jet nozzle once mixing has become established.

An example of a suitable precessing jet nozzle 20' is depicted in FIG. 2, and includes an axisymetric chamber 40 with a simple 42 or profiled 42' inlet aperture defining a large sudden expansion at the chamber's inlet end, and a small peripheral lip 44 defining an exit port 46. The fuel jet 48 enters chamber 40 at aperture 42 or 42' and is there separated from the chamber wall. The jet then reattaches asymmetrically at 50 to the inside of the wall and at the nozzle exit is deflected (52) at a large angle (eg 45°) from the nozzle axis by strong local pressure gradients. There are also strong azimuthal pressure gradients which cause the jet, and the entire flow field within the chamber, to precess about the nozzle axis. These pressure gradients and fields induce air 54 through the outlet 46 and this air swirls in the chamber at 55 between the flow separation and the reattachment and in part induces the precession of the separated/reattached flow. This precession enhances mixing of the fuel flow with the air from the exterior of the chamber.

Further particulars and embodiments of precessing jet nozzles are disclosed in international patent application PCT/AU88/00114 (publication no. WO88/08104) and in the associated national and regional patent publications including U.S. Pat. No. 5,060,867.

The turbulent jet nozzle 20 may be, eg, a straight tube burner pipe, a single channel for gas without the use of primary air. This nozzle type operates as a turbulent jet and the kinetic energy of the fuel jet is progressively dissipated by mixing and entrainment with the surrounding air. Thus, its mixing characteristics are quite different from those of the nozzle 20' as depicted in FIG. 2. Other kinds of burner nozzle may be used for the nozzle 30, for example a burner using some cold primary air, eg 15% of the total air entrained, to increase the momentum of the gas jet and hence the entrainment capacity of the stream.

With the burner configuration illustrated in FIG. 1, the precessing jet nozzle 20 produces a shorter more radiant flame, while the simple turbulent jet nozzle 30 itself produces a long convective flame. By relative adjustment of valves 24,34 using any suitable control means 25, which may be manual, the proportions of fuel flow to the respective nozzles can be varied so that the combined flame and the resultant heat release profile of the combined flame can be tailored to the requirements of the kiln. In the case of a cement clinker kiln, it has been found that, not only does the burner configuration of FIG. 1 enable the combined flame to be controlled to suit the given type of cement clinker, it also enables greater control of the kiln to be achieved and facilitates the relatively easy removal of rings of coating which occasionally form. To explain this latter point further, the clinker in the burning zone within the kiln, ie where the clinker undergoes the exothermic clinkering reaction and reaches its maximum temperature, is sticky and forms a coating on the refractory brick lining within the kiln. This is an advantage to the operation since the coating acts as an insulating layer which protects the bricks. However, under some conditions an annular ring of coating can develop which causes the clinker to build up behind it. If the ring breaks, a rush of clinker through the kiln can cause serious problems and may result in damage to the plant. The development of a ring is related to the heat release profile, so that the ability to vary that profile with a burner configuration according to the invention facilitates the early removal of a ring before it becomes a problem.

It has been established that the burner configuration depicted in FIG. 1 still achieves a 50% reduction in $NO_X$, and yet results in a significant improvement in the quality of the cement clinker produced.

Figure 3:
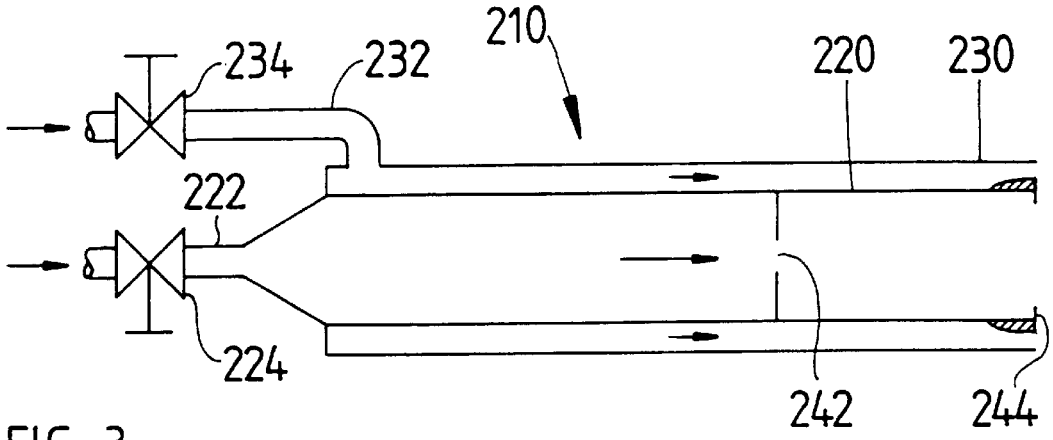
FIGS. 3 to 5 schematically illustrate respective alternative burner configurations according to further embodiments of the invention.
Figure 4:
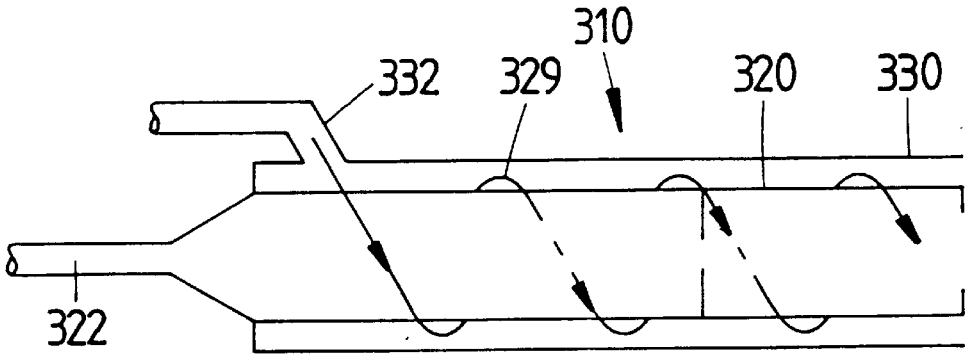
Figure 5:
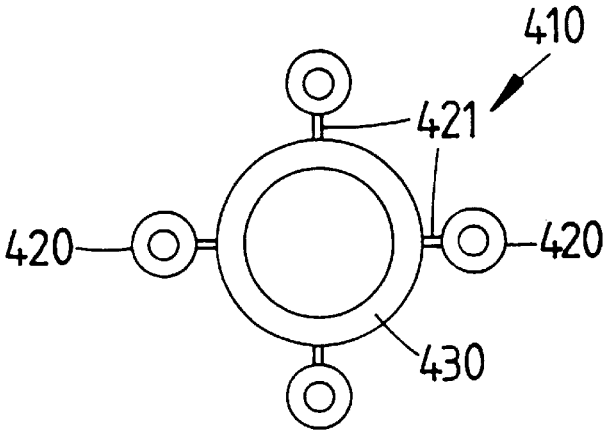

FIGS. 3 to 5 illustrate alternative embodiments of burner configuration according to the invention, in which like components are indicated by like two-digit reference numerals preceded by different integers. The arrangement shown in FIG. 3 comprises a concentric pipe burner configuration 210, consisting of a precessing jet nozzle 220 mounted substantially concentrically within an outer pipe 230 defining a co-annular burner pipe. The co-annular pipe 230 may or may not have a flow-directing nozzle in the end and may or may not be used to cool the inner nozzle/burner 220. In the case where a flow-directing nozzle 332 is used to swirl the co-annular flow, a co-annular swirl burner 310 is produced: this is depicted in FIG. 4, in which the swirl flow is indicated by arrow lines 329. FIG. 5 is an end view of a multi-pipe burner configuration 410, consisting of a ring of four equiangularly spaced precessing jet nozzles/burners 420 arranged around one or more turbulent jet nozzles/burners 430. Jet nozzles/burners 420 are supported by radial spacer elements 421. The converse—a ring of turbulent jet nozzles/burners around one or more precessing jet nozzles/burners—is of course also an option within the broad scope of the invention.

It is emphasised that the illustrated flow control means comprising valves 24,34;224,234 etc is only one of a variety of possible arrangements for varying the ratio of flow to any of the two or more nozzles. For example, when the pressure drops through each of the two nozzles or sets of nozzles are approximately the same, a single valve may be used to control the ratio of flows through the respective nozzles.

Figure 6:
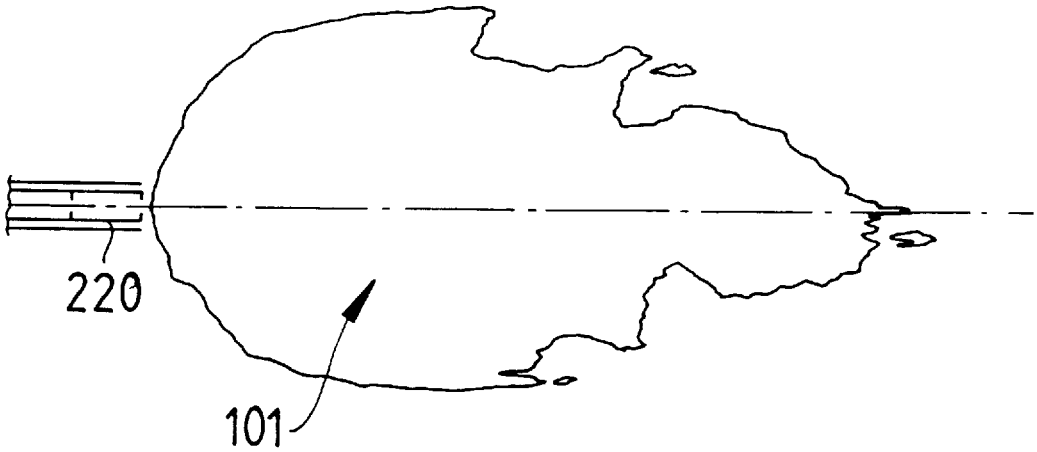
FIG. 6 depicts approximate flame shapes for different operational settings of the co-annular burner configuration illustrated in FIG. 3.
Figure 6:
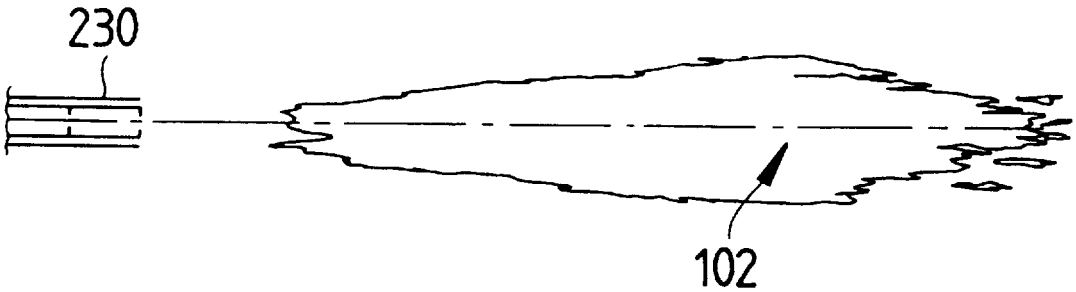
Figure 6:
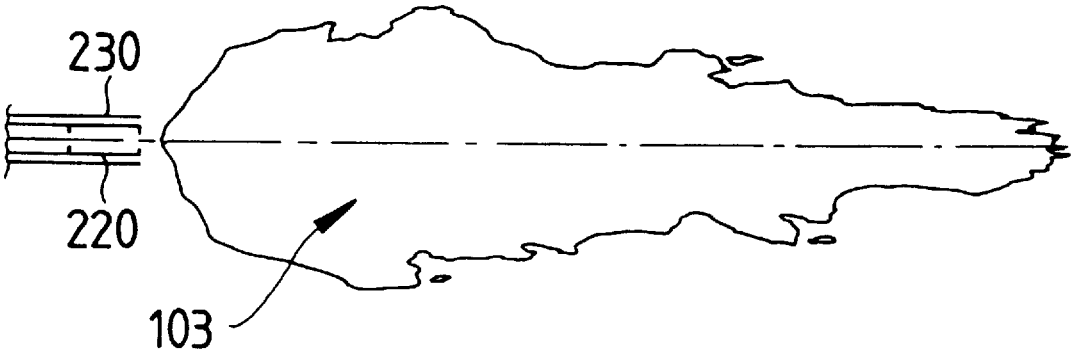

FIG. 6 depicts approximate flame shapes for different operational settings of the co-annular burner configuration illustrated in FIG. 3. With fuel delivered only to the inner precessing jet nozzle 220 [FIG. 6(*a*)], the flame 101 is highly luminous and relatively bulbous. Flame 101 is a highly radiant but relatively low temperature flame close to the nozzle exit. By contrast, with fuel delivered only to the co-annular jet nozzle 230, the flame 102 [FIG. 6(*b*)] is relatively long and thin, projecting further from the nozzle. Flame 102 is moreover an initially and mainly higher temperature blue flame with an orange tail. The combined flame 103 depicted in FIG. 6(*c*) is for a proportional delivery of fuel of 60% to precessing jet nozzle 220 and 40% to co-annular nozzle 230. Flame 103 is highly luminous throughout and a mix of the features of flames 101,102.

A comparison was made between clinker produced in a cement clinker kiln with a traditional turbulent straight tube burner nozzle, and clinker produced with a burner configuration as illustrated in FIGS. 1 and 2, in which 63% of gas fuel was directed to the precessing jet nozzle. The smaller well-defined and colourful (aqua blue) alite crystals and smaller well-shaped belite crystals evident in the latter case were evident of a more reactive clinker, believed to be brought about by the improved heat profile in the kiln.

We claim:

1. A burner comprising a plurality of nozzles, at least one of said nozzles being a processing jet nozzle having a first fuel/air mixing characteristic to provide a first flame and at least one additional nozzle having a second fuel/air mixing characteristic different from said first mixing characteristic for providing a second flame different from said first flame, said nozzles being disposed adjacent each other to provide a combined flame different from said first and second flames, wherein said at least one processing jet nozzle is comprised of a fluid mixing nozzle in which operation of a primary flow of a first fluid separates from an internal wall structure and reattaches itself asymmetrically to the wall structure upstream of a nozzle outlet whereby a flow of a second fluid is induced through the outlet swirling in a chamber between a point where said first fluid separates from said wall structure and a second point where said fluid reattaches itself to said wall structure for inducing precession of the separated and reattached flow which exits said nozzle asymmetrically.

2. A burner as set forth in claim 1, further comprising fuel supply means for supplying fuel to each of said nozzles and control means for controlling the proportions of fuel flow to said nozzles.

3. A burner as set forth in claim 1, wherein said at least one additional nozzle is a turbulent jet nozzle for producing a flame relatively longer and thinner than a relatively short bulbous flame produced by said precessing jet nozzle.

4. A burner as set forth in claim 1, wherein said nozzles extend in generally parallel adjacent spaced apart relation with respect to each other.

5. A burner as set forth in claim 1, wherein a plurality of additional nozzles are provided with said additional nozzles disposed in concentric relation about said precessing jet nozzle.

6. A burner as set forth in claim 1 wherein said nozzles are arranged generally concentrically with said precessing jet nozzle being substantially concentrically disposed within said at least one additional nozzle.

7. A burner as set forth in claim 6, further comprising fluid directing means for swirling fuel in said at least one additional nozzle about said precessing jet nozzle.

* * * * *